US007070037B2

(12) United States Patent
Navis

(10) Patent No.: US 7,070,037 B2
(45) Date of Patent: Jul. 4, 2006

(54) SYSTEM AND METHOD FOR DETERMINING THE NUMBER AND VALUE OF COINS IN A COIN DISPENSING MACHINE

(76) Inventor: Glen Navis, 522 E. Lincoln St., Waupun, WI (US) 53963

( * ) Notice: Subject to any disclaimer, the term of this patent is extended or adjusted under 35 U.S.C. 154(b) by 128 days.

(21) Appl. No.: 10/726,289

(22) Filed: Dec. 2, 2003

(65) Prior Publication Data

US 2005/0118941 A1 Jun. 2, 2005

(51) Int. Cl.
*G06M 9/00* (2006.01)
*G07D 9/00* (2006.01)

(52) U.S. Cl. ..... 194/215; 453/16

(58) Field of Classification Search ..... 194/215, 194/216, 217; 453/16, 17, 58, 61
See application file for complete search history.

(56) References Cited

U.S. PATENT DOCUMENTS

| | | | | |
|---|---|---|---|---|
| 4,374,529 | A | 2/1983 | Kobayashi et al. | 133/4 |
| 4,646,767 | A | 3/1987 | Hikita | 133/8 |
| 4,774,841 | A | 10/1988 | Chadwick | 73/597 |
| 5,501,633 | A | 3/1996 | Watkins et al. | 453/17 |
| 5,742,656 | A * | 4/1998 | Mikulak et al. | 377/7 |
| 5,757,876 | A * | 5/1998 | Dam et al. | 377/7 |
| 6,267,662 | B1 | 7/2001 | Jard et al. | 453/17 |
| 6,425,817 | B1 * | 7/2002 | Momemy | 453/17 |
| 2003/0120383 | A1 | 6/2003 | Shur | |
| 2004/0045787 | A1 * | 3/2004 | Zimmermann | 194/216 |

FOREIGN PATENT DOCUMENTS

DE 102.13.293 A1 * 10/2003

* cited by examiner

*Primary Examiner*—Eileen D. Lillis
*Assistant Examiner*—Mark J Beauchaine
(74) *Attorney, Agent, or Firm*—Andrus, Sceales, Starke & Sawall, LLP

(57) ABSTRACT

A method and system for determining the monetary value of coins included in a plurality of stacks of coins arranged for dispensing from an automatic coin dispensing machine are provided. The method and system employ a sensor arranged to determine the height of the stack of coins in each of the plurality of stacks of coins and a microprocessor in communication with the ultrasonic sensor. The microprocessor is adapted to determine the monetary value of coins in each of the plurality of stacks of coins.

16 Claims, 5 Drawing Sheets

SYSTEM AND METHOD FOR DETERMINING THE NUMBER AND VALUE OF COINS IN A COIN DISPENSING MACHINE

FIELD OF THE INVENTION

The present invention relates to a system and method for determining the monetary value of coins in an automatic coin dispensing machine.

BACKGROUND OF THE INVENTION

Automatic coin dispensers are widely used in the banking, retail and commercial industries. For example, coin dispensers facilitate cash transactions between tellers and customers at banks. Coin dispensers also facilitate cash transactions between employees and customers at grocery and department stores, retail shops, amusement parks, and gas stations. In the retail setting, coin dispensers typically communicate with a cash register, which is manually operated by one or more employees. When the customer gives a particular denomination of money to the employee, the register is manually operated and then communicates with the coin dispenser to provide the appropriate denomination of change to the customer.

Known automatic coin dispensers include the type having a removable panel tray or magazine for holding a series of adjacent stacks of coins. Beneath each of the stacks of coins is a dispensing mechanism, typically a "kick finger", which dispenses the bottom-most coin into a central trough that feeds into a customer collection cup. Panel-type coin dispensers usually employ two rows of each coin type, with extra rows of pennies to ensure adequate supply.

Another known type of automatic coin dispenser is the type having a revolving removable carousel or magazine mounted to a rotating turret. The revolving carousel holds a circular series of stacks of coins. The turret is selectively automatically rotatable to rotate the carousel such that a desired stack of coins is positioned above a single dispensing mechanism, usually a kick finger. The dispensing mechanism discharges the bottom-most coin in the stack of coins into a customer pick-up tray. In any particular change-giving event, the turret rotates selected coin stacks above the dispenser, in turn, to discharge a selected number of each denomination of coin, for example different combinations of quarters, dimes, nickels and pennies. This type of coin dispensing machine is manufactured by DeLaRue International Ltd. and sold under the model name Insta Change.

During a typical business day, it is often necessary to determine the total value of coins held by the coin dispenser. For example, in a typical day a number of different employees operate the same cash register. At the end of each employees' shift, it is desirable to determine the amount of coinage in the dispenser prior to the next employee beginning their shift. This is often required to ensure that the proper change was given during the previous employee's shift, to track inventory and profits, and to ensure that no theft is occurring.

However, a particular problem associated with known automatic coin dispensers is that at any particular time, it is difficult to determine the total value of coins held by the coin dispenser. Currently known methods for valuating the inventory in the coin dispenser include providing a series of markings along coin tubes that house the stacks of coins. According to this method, a user visually inspects each coin tube and compares the height of coins to the markings on the coin tube, and then manually calculates the total value of coins held by the coin dispensing machine. This method is both time consuming and can lead to inaccurate coin value determinations.

Another solution to this problem is an automatic coin counting machine, which automatically counts the value of a series of coins. However, know coin counting machines are typically expensive to manufacture, are labor intensive as they require additional operators, and require additional processing steps typically performed in separate "coin counting rooms". Another drawback to known coin counting machines is that by increasing the number of individuals handling the inventory, the possibility of theft is increased.

Therefore, there is currently a great need for a more efficient system and method for determining the number and value of coins in an automatic coin dispensing machine. It is desirable to provide such a system and method which solves the many problems associated with known valuation systems and methods. It is desirable to provide such an improved system and method which eliminates inaccurate valuations. It is desirable to provide such a system and method which is efficient and eliminates waste of valuable labor time. It is desirable that such an improved system and method limits the number of individuals handling the coin inventory, to thus deter theft.

SUMMARY OF THE INVENTION

The present invention relates to such an efficient system and method for determining the monetary value of coins included in a plurality of stacks of coins arranged for dispensing from an automatic coin dispensing machine. The valuation system includes a sensor and microprocessor arranged to determine the height of the stack of coins in each of the plurality of stacks of coins. The microprocessor is adapted to determine the monetary value of coins in each of the plurality of stacks of coins by (a) determining the type of coin in each of the plurality of stacks of coins; (b) determining the number of coins in each of the plurality of stacks of coins by dividing the determined height by a known coin height for the determined type of coin in each of the stacks of coins; (c) determining a monetary value of the coins in each of the plurality of stacks of coins by multiplying the determined number of coins by a known coin value for the determined type of coin in each of the plurality of stacks of coins; and (d) determining an overall monetary value for the coins in the plurality of stacks of coins by summing the determined monetary value for each of the plurality of stacks of coins. The valuation system also includes a display in communication with the processor for visually displaying the overall monetary value of the plurality of stacks of coins.

According to the method of the present invention, the monetary value of coins in a plurality of stacks of coins arranged for dispensing from an automatic coin dispensing machine is determined. The method includes the steps of (1) positioning at least one sensor coupled to a microprocessor to determine the height of the stack of coins in each of the plurality of stacks of coins; (2) determining the type of coins in each of the plurality of stacks of coins; (3) determining the number of coins in each of the plurality of stacks of coins by dividing the determined height for each of the stacks of coins by a known coin height for the determined type of coin in each of the plurality of stacks; (4) determining the monetary value of the coins in each of the plurality of stacks of coins by multiplying the determined number of coins by a known coin value for the determined type of coin in each of the plurality of stacks of coins; (5) determining an overall monetary value for the coins in the plurality of stacks of coins by summing the determined monetary value of the coins in each of the plurality of stacks of coins and; (6) displaying the overall monetary value for the coins in the plurality of stacks of coins.

The present invention thus provides a more efficient system and method for determining the number and value of coins in an automatic coin dispensing machine. The present invention solves the many problems associated with known valuation systems and methods. The present invention provides an improved system and method that eliminates inaccurate evaluations and efficiently eliminates waste of valuable labor time. The present invention also limits the number of individuals handling the coin, inventory, thus deterring theft.

BRIEF DESCRIPTION OF THE DRAWINGS

Preferred embodiments of the invention are described herein below with reference to the attached drawing figures, wherein.

DETAILED DESCRIPTION OF THE PREFERRED EMBODIMENTS

In the preferred embodiments of the present invention described in detail below, a system and method for determining the monetary value of coins in an automatic coin dispensing machine is provided. It should be understood that the drawings and specification are to be considered an exemplification of the principles of the invention, which is more particularly defined in the appended claims.

Figure 1:
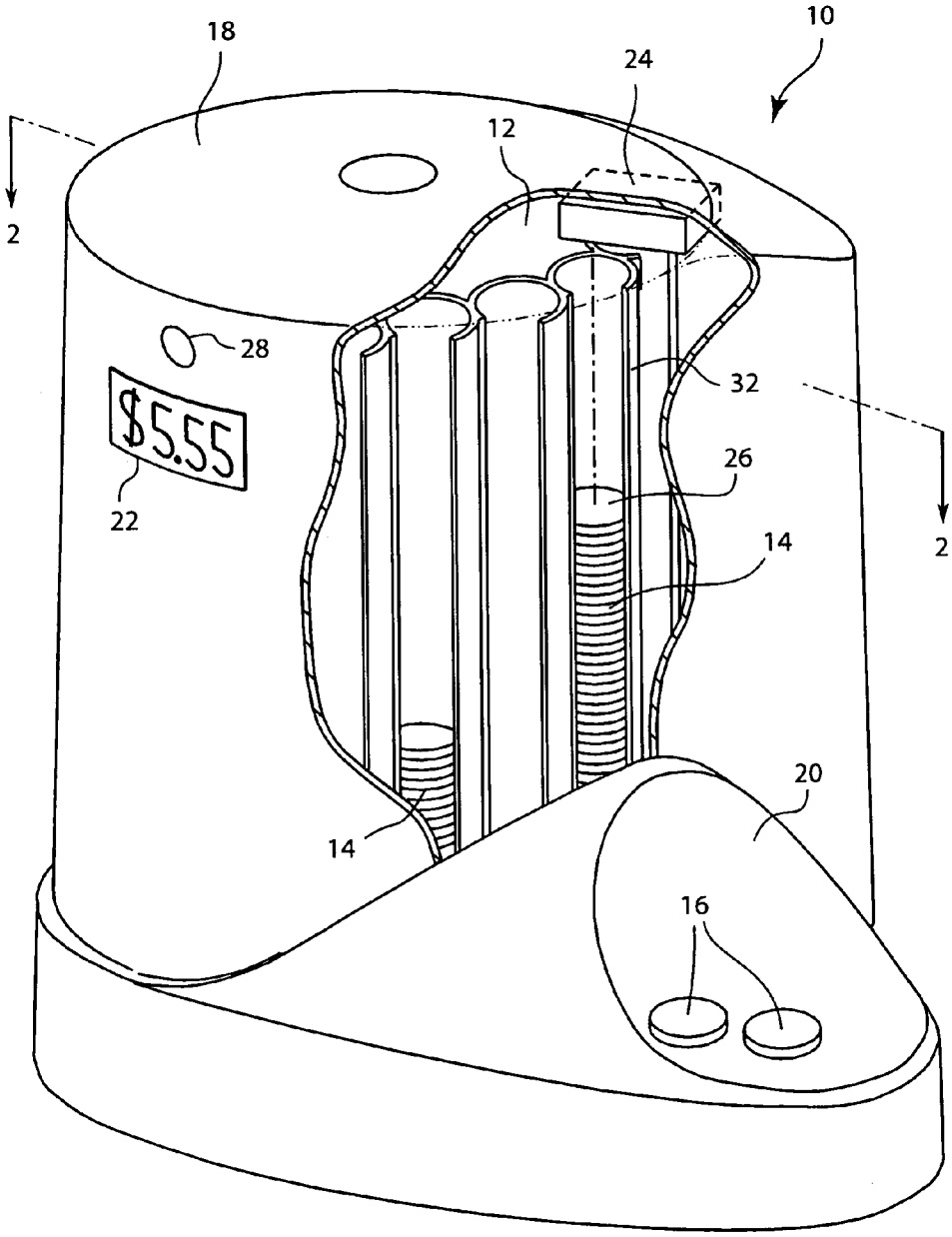
FIG. 1 is a perspective view of the present invention disposed in an automatic coin dispensing system of the type having a revolving removable magazine or carousel containing a plurality of stacks of coins.

Referring to FIG. 1, an automatic coin dispenser 10 is shown. The automatic coin dispenser 10 is of the type having a revolving carousel 12 containing a plurality of stacks of coins 14. This type of coin dispenser 10 is well known in the art and efficiently, automatically discharges a selected number and variation of multiple denominations of coins 16, for example different combinations of quarters, dimes, nickels and pennies. The automatic coin dispenser 10 has a cover 18 and a discharge tray 20, which receives the discharged coins 16 from the carousel 12. The discharge tray 20 serves as a customer pick-up tray, whereby a customer can manually pick up his or her change after a particular cash transaction event.

The cover 18 may include an electronic display 22 for displaying the total value of coinage in the automatic coin dispenser 10, which is determined according to the system and method described below. The display 22 shown in FIG. 1 is preferably built into the cover 18 of the automatic coin dispenser 10. The display 22 is operable to provide a visual indication to a user of the value of the coins contained within the automatic coin dispenser. Although FIG. 1 illustrates the display 22 as being built into the cover 18, it should be understood that the display 22 could be positioned in other locations either on the cover or near the automatic coin dispenser 10. The electronic display can be one of many different types of displays, such as an LCD screen, an eight segment LED display panel, or any other type of similar device used to display alphanumeric characters.

The cover 18 also includes an activation button 28 that can be depressed to activate a sensor 24 and the drive mechanism for the coin dispenser to determine the overall monetary value of the plurality of stacks of coins 14, as will be described further below. As illustrated in FIG. 1, the activation button 28 is also recessed into the cover 18 of the automatic coin dispenser 10. The activation button 28 can be located anywhere along the cover 18, although the close proximity of the activation button 28 to the display 22 allows the activation button to be readily located by an employee. Alternatively, the activation button 28 can be located remotely from the automatic coin dispenser 10, such as near the cash register or in another desirable location. In yet another contemplated embodiment, the function of the actuation button can be directly incorporated into the cash register such that the coin counting can be initiated by the cash register either through a manual button or automatically.

Figure 3:
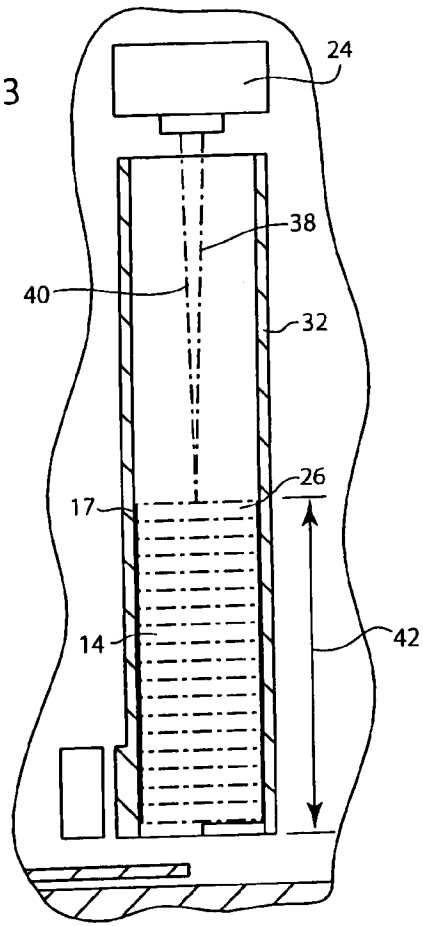
FIG. 3 is a detailed sectional view of a stack of coins in either the automatic coin dispenser shown in FIG. 2 or the automatic coin dispenser shown in FIG. 4.

As shown in FIG. 1, the sensor 24 is disposed in the automatic coin dispenser 10 and arranged to emit an ultrasonic pulse downward along the coin tube and onto a top coin 26 in each of the plurality of stacks of coins 14. Referring to FIG. 3, the sensor 24 may comprise one of a variety of different types of sensors, such as sensors arranged to emit lasers or beams of light onto the stack of coins 14. In the particular embodiments shown and discussed below, the sensor 24 is an ultrasonic sensor arranged to emit an ultrasonic pulse 38 onto the top coin 26 in each of the plurality of stacks of coins 14. The sensor 24 is further arranged to receive the ultrasonic pulse 40 that is reflected off of the top coin 26 in the stack 14.

Figure 2:
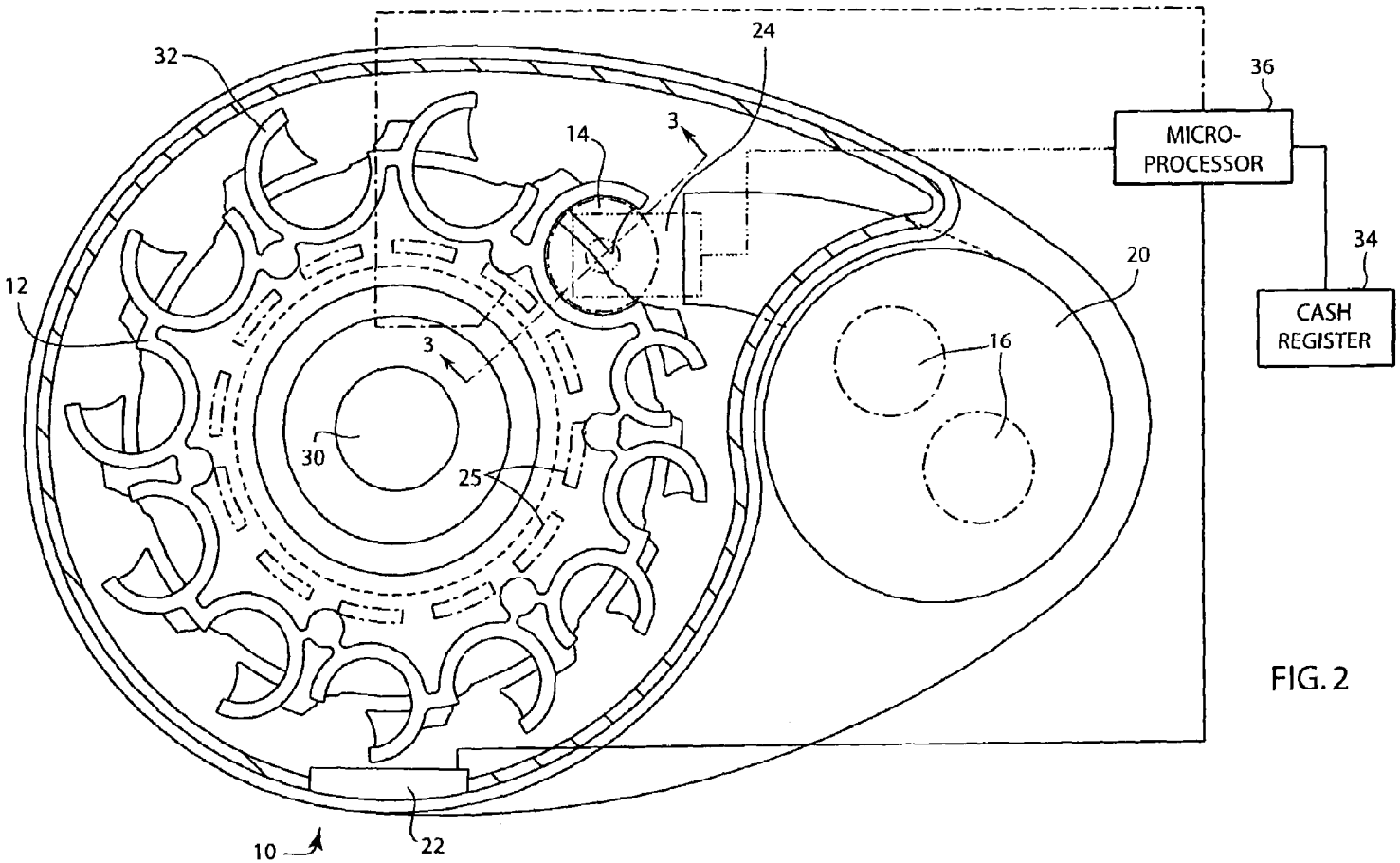
FIG. 2 is a top sectional view of the automatic coin dispenser shown in FIG. 1.

Referring now to FIG. 2, the revolving removable carousel 12 of the automatic coin dispenser 10 is mounted to a rotating turret 30. The plurality of stacks of coins 14 are each held by a coin tube 32 mounted along the outer circumference of the carousel 12. In addition, a series of coin tube sensors 25 are disposed around the circumference of the turret 30, one coin tube sensor 25 for each coin tube 32. As is well known in the art, the coin tube sensors 25 determine the type of coin 16 in the coin tube 32. However, it should be recognized that although the automatic coin dispenser 10 shown and described employs a series of coin tube sensors 25, the system and method of the present invention may be adapted to function with an automatic coin dispenser 10 without coin tube sensors 25, or alternatively, with an automatic coin dispenser 10 having only a single stationary coin tube sensor 25 which senses the types of coins 16 in each of the plurality of coin tubes 32.

The automatic coin dispenser 10 discharges a selected variety and number of coins according to a procedure that is well known in the art. Namely, in a particular change-giving event, the automatic coin dispenser 10 receives communication from a cash register 34. The coin dispenser 10, or in certain applications the cash register 34, determines how many of each denomination of coin 16 are necessary to dispense the appropriate value of change required. The coin dispenser 10 rotates turret 30 and carousel 12 to position a selected coin tube 32 and coin stack 14 over a discharge mechanism (not shown). The discharge mechanism then discharges the appropriate number of the particular denomination of coin 16 in the particular stack of coins 14 to the discharge tray 20. This procedure is repeated for each selected stack of coins 14 in the carousel 12 until the proper denomination of coinage is dispensed.

As shown in FIG. 2, a microprocessor 36 is adapted to communicate with both the cash register 34 and the sensor 24 to determine the total monetary value of coins 16 in the plurality of stacks of coins 14 held by the automatic coin dispenser 10. In the embodiment shown, the microprocessor 36 is also adapted to communicate with the coin tube sensors 25 to determine the type of coin 16 held by each coin tube 32. Alternatively, however, the microprocessor 36 may be programmed with this information or receive this information from the cash register 34.

The microprocessor 36 is programmed with an individual coin height for each of the different denominations of coin. For example, the microprocessor 36 is programmed to understand that a quarter is of a certain height, and that a nickel is of a certain height, etc.

The microprocessor 36 is also programmed with a reference time period. The reference time period represents the time period between emission and reception of an ultrasonic pulse directed by the sensor 24 into an empty coin tube 32. The reference time period may alternatively represent the time period between emission and receipt of an ultrasonic pulse directed by the sensor 24 onto a certain reference coin stack height, such as, for example, a coin stack height for a coin tube 32 full of coins 16.

The microprocessor 36 is also programmed with a value for each type of coin 16. For example, the microprocessor 36 is programmed to understand that a quarter has a value of 25 cents and that a nickel has a value of 5 cents, etc.

Although the microprocessor 36 is shown in the preferred embodiment of FIG. 2 as being positioned between the cash register 34 and the coin dispenser 10, it should be understood that the microprocessor 36 or its operational features could be incorporated directly into the cash register 34. The cash register 34 typically includes its own microprocessor or controller that could be selectively programmed to carry out the functional features of the microprocessor 36 as described above. Alternatively, the microprocessor 36 could be incorporated directly into the coin dispenser 10 and communicate with the cash register 34. As understood by the above description, the functional operation carried out by the microprocessor 34 can be distributed throughout the combined system while functioning within the scope of the present invention.

Figure 5:
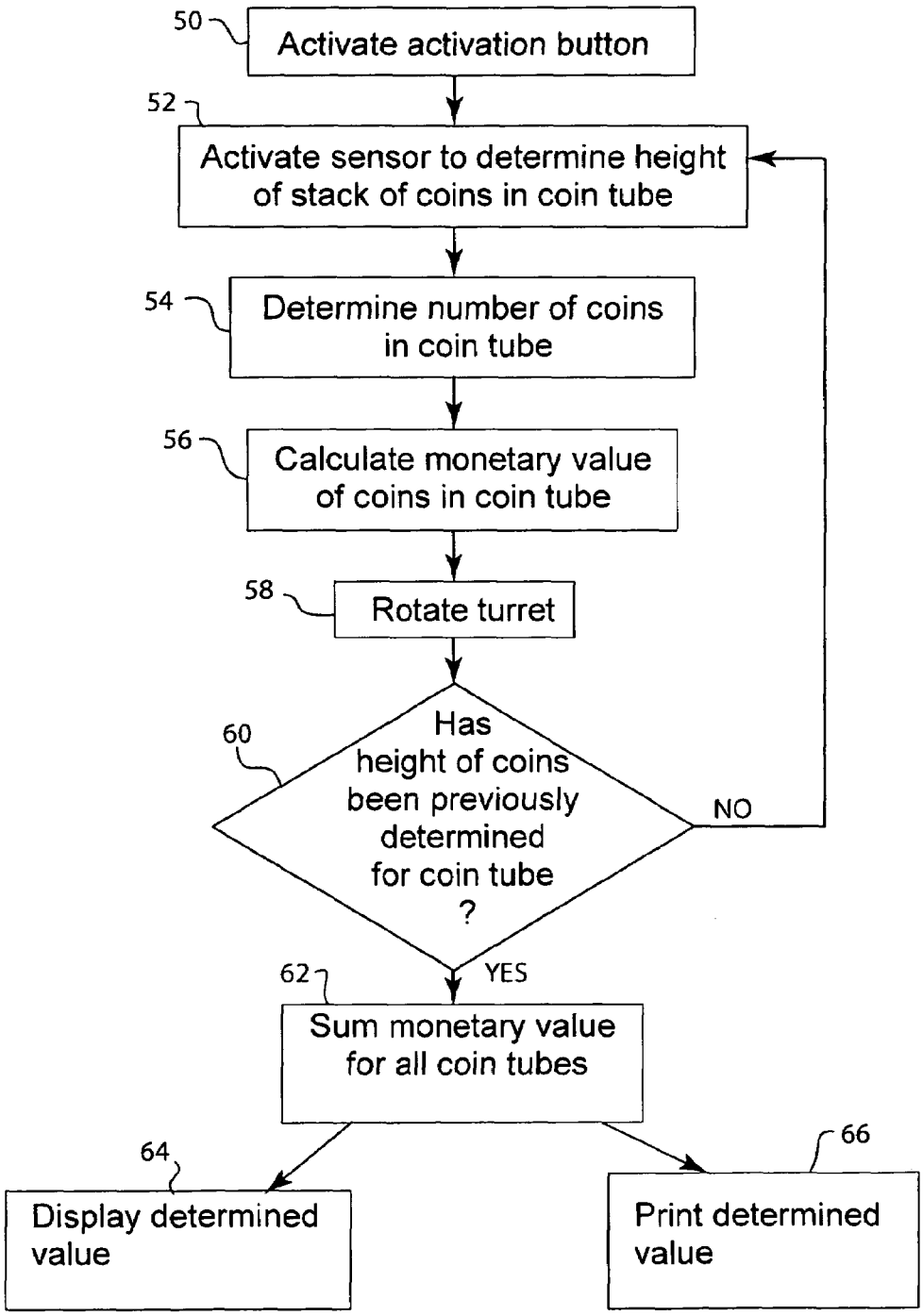
FIG. 5 is a flow chart depicting several steps in the preferred method of the present invention.

Referring now to FIGS. 2, 3 and 5, the method of the present invention will be described. At step 50, a user, such as store employee, presses the activation button 28 to activate the valuation system and begin the valuation process. Typically, the activation button is depressed at the beginning or end of a work shift when an employee needs to know the cumulative monetary value of the coins in the dispenser. More specifically, the activation button 28 provides an activation signal to the microprocessor 36, which in turn causes the sensor 24 to emit an ultrasonic pulse 38 onto the top coin 26 in a first of the stacks of coins 14 and subsequently receives reflected pulse 40 off of the top coin 26. It should be recognized, however, that the microprocessor 36 and sensor 24 may be actuated by other known actuation means, such as for example voice actuation means, or by the cash register. The microprocessor 36 and sensor 34 may also be automatically actuated based on, for example a timer.

At step 52, the microprocessor 36 determines the height 42 of the stack of coins 14 based on the emitted and reflected ultrasonic pulses 38, 40, as illustrated in FIG. 3. More specifically, the microprocessor 36 determines the height 42 based upon the time period between the emission and receipt of ultrasonic pulses 38, 40. Based upon the time period between emission and receipt, the microprocessor 36 is programmed to correlate this value to a certain coin stack height. Inherently, the longer the time period between emission and receipt of the ultrasonic pulses 38, 40, the smaller the value of the coin stack height 42. The microprocessor 36 is programmed to calculate this correlation and thus efficiently and accurately determine coin stack height 42.

Alternately, the height 42 of the coin stack can be determined by comparing the time period between the emission and receipt of ultrasonic pulses 38, 40 to the reference time period for emission and receipt of the reference ultrasonic pulse (discussed above) onto the reference coin stack height. More specifically, the microprocessor 36 subtracts the reference time period from the determined time period between emission and receipt of ultrasonic sonic pulses 38, 40. According to this value, the microprocessor determines the height 42 of the stack of coins 14. Again, the microprocessor 36 is programmed to understand that a certain time period between emission and receipt of ultrasonic pulses 38, 40 correlates to a certain coin stack height. Thus, in this manner, each calculated difference in time periods designates a certain height 42 of the stack of coins 16 held in the coin tube 32.

At step 54, the microprocessor 36 determines the number of coins 16 in the stack of coins 14 by dividing the determined height 42 by the known coin height 17 for the particular type of coin 16 held by the coin tube 32. For example, if the determined height is 1 inch and the coin tube 32 holds a stack of nickels, which each have, for example, a height of 1/16 inch, the number of coins 16 in the stack of coins 14 would be sixteen.

At step 56, the microprocessor 36 calculates the total monetary value of the stack of coins 14 by multiplying the determined number of coins 16 in the stack of coins 14 by the known value for each individual coin 16. For example, if the stack of coins 14 is nickels, and the determined number of coins 16 is sixteen, the total monetary value would be $0.80.

At step 58, the microprocessor 36 communicates with the automatic coin dispenser 10 to rotate the turret 30 and the carousel 12 and repeat the above steps for each stack of coins 14 held by the automatic coin dispenser 10. This process continues until the microprocessor 36 has measured the coin height 42 in each of the coin tubes 32 of the dispenser 10.

The microprocessor 36 is programmed to determine the point at which the monetary value for each of the coin tubes 32 in the coin dispenser 10 has been calculated. At step 60, after the turret 30 is rotated and a new coin tube 36 is positioned beneath the sensor 24, the microprocessor 36 determines whether a height 42 and value for the particular coin tube 32 has previously been determined. If the answer is no, then the microprocessor 36 completes steps 52 through 58 for the coin tube 32. If the answer is yes, then the microprocessor 36 proceeds to step 62 to calculate the overall monetary value of the coins 16 in the coin dispenser 10.

Alternatively, the microprocessor 36 may also be programmed to calculate the monetary value for only a single coin tube 32, or a selected number of different coin tubes 32, etc. In this case, the microprocessor 36 will complete steps 52 through 58 for only the selected coin tube(s).

At step 62, the microprocessor 36 determines the overall monetary value for the plurality of stacks of coins 14 held in the automatic coin dispenser 10 by summing the determined monetary value for each stack of coins 14. Although this step is shown in FIG. 5 only after the monetary value for each coin tube has been calculated, it should be understood that the microprocessor can keep a running total as each coin tube is calculated. This overall monetary value represents the total value for the coins 16 held by the automatic coin dispenser 10. Thus, by the system and method described above, an efficient means for obtaining a value of coins held by an automatic coin dispenser 10 is provided.

The overall monetary value determined for the automatic coin dispenser 10 may be provided to the user in any one of a variety of formats. Optionally, at step 64, the microprocessor 36 communicates with the display 22 to display the overall monetary value. The display 22 may comprise any means for providing visual indication of the overall monetary value that are well known in the art. In the preferred embodiment, the display 22 consists of an LCD display that indicates the monetary value. Optionally, at step 66, the microprocessor 36 communicates with the cash register 34, or other printer, to print the overall determined monetary value. Optionally, at step 64, the microprocessor 36 communicates with a voice module (not shown) which provides an audible indication of the determined monetary value.

Figure 4:
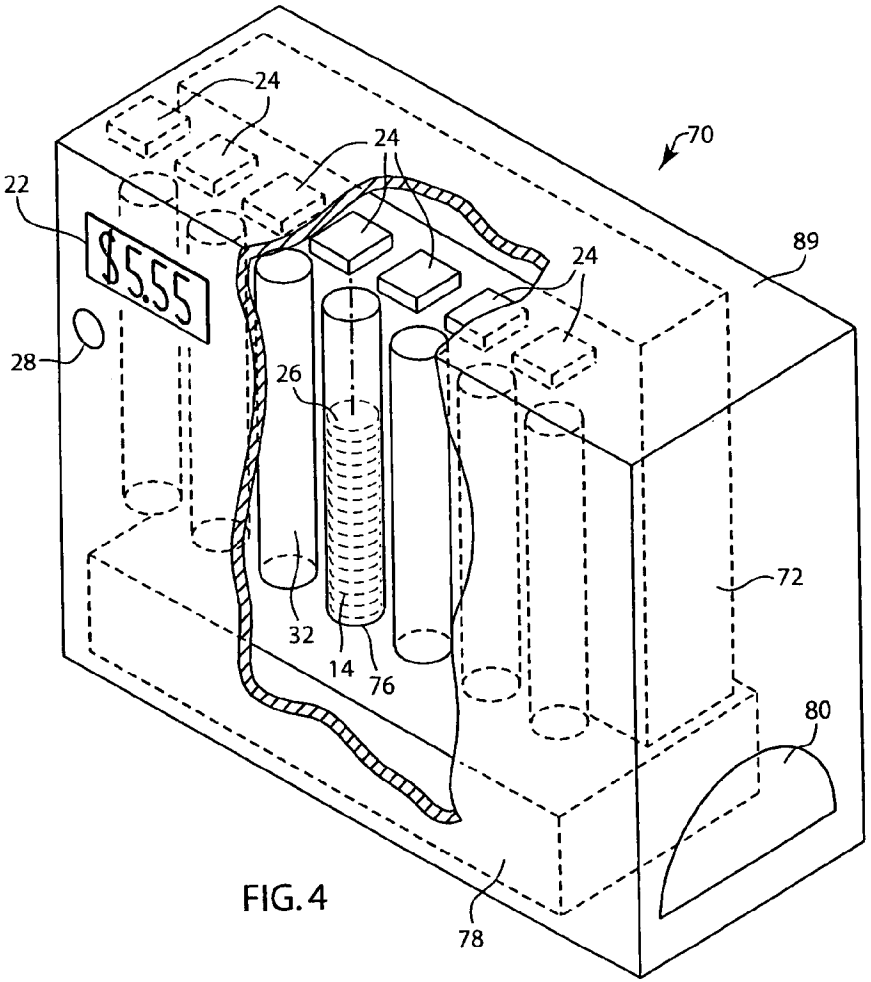
FIG. 4 is a perspective view of the present invention disposed in a coin dispenser of the type having a removable magazine or panel tray for holding a series of adjacent stacks of coins.

Referring to FIG. 4, an alternate embodiment of the system of the present invention is shown which comprises an automatic coin dispenser 70 of the type having a removable magazine or panel tray 72 for holding a plurality of stacks of coins 14. Beneath each of the plurality of stacks of coins 14 is a dispensing mechanism (not shown), which dispenses the bottom-most coin 76 into a central trough 78 that feeds into a customer collection cup 80. Each of the plurality of stacks of coins 14 are held by a coin tube 32.

As shown in FIGS. 3 and 4, a sensor 24 is disposed above each of the coin tubes 32. As in the embodiment described above, the sensors 24 are arranged to emit an ultrasonic pulse 38 onto a top coin 26 in the stack of coins 14 and to receive a reflected pulse 40 therefrom.

The automatic coin dispenser 70 also includes a cover 89 which has a display 22 for displaying the total value of coinage in the automatic coin dispenser 70. The cover 89 also includes an activation button 28, similar to the embodiment shown and described above.

Figure 6:
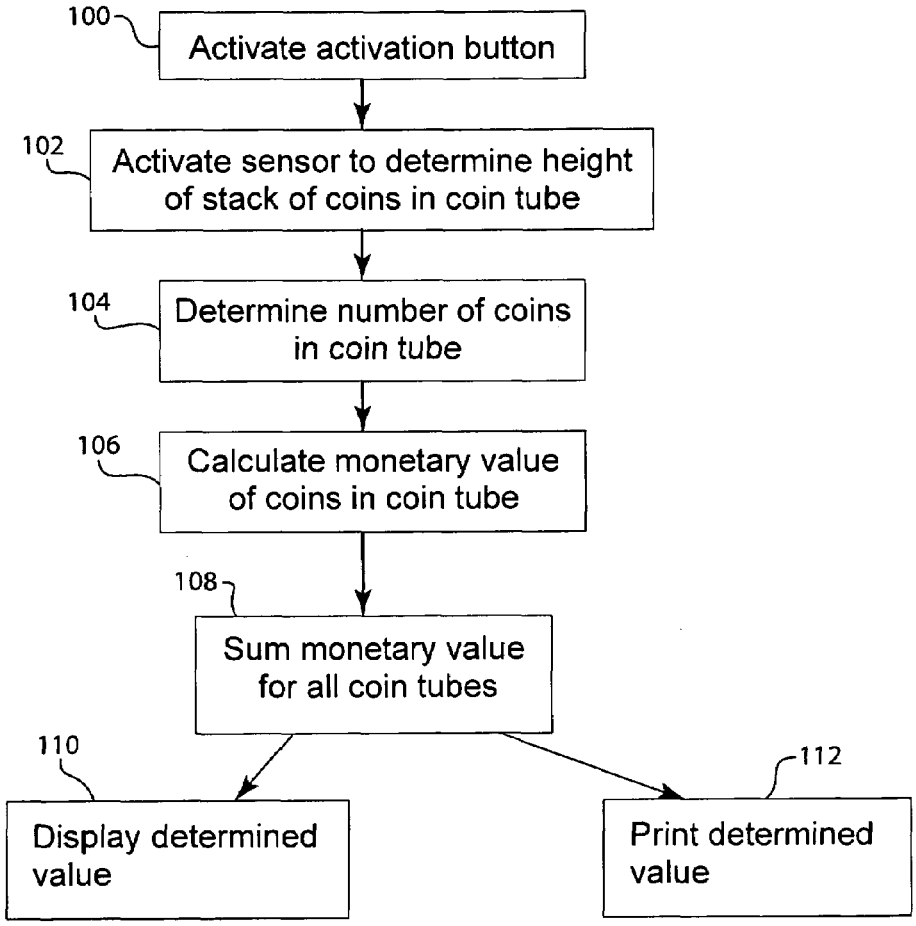
FIG. 6 is a flow chart depicting several steps in an alternative method of the present invention.

According to the system shown in FIG. 4, and the steps of the method depicted in FIG. 6, the microprocessor communicates with each sensor 24 to determine the coin stack height 42 for each coin tube 32 and to calculate the monetary value of the coins in each of the coin tubes 32. More specifically, at step 100, a user presses the activation button 28 to activate the valuation system and begin the valuation process. The activation button 28 actuates the microprocessor 36, which in turn causes each sensor 24 in the series of sensors to emit an ultrasonic pulse 38 onto a top coin 26 in the stack of coins 14 and subsequently to receive a reflected pulse 40 off of the top coin 26. As explained above, the microprocessor 36 may alternatively be actuated by a variety of means, such as voice activation, or a timer, etc.

As detailed above for steps 52, 54 and 56, at steps 102, 104 and 106, the microprocessor 36 determines the height 42 of each stack of coins 14 held by the automatic coin dispenser 70, the number of coins in each stack, and the monetary value of the coins in each stack. More specifically, at step 102, the microprocessor 36 determines the height 42 based upon the time period between the emission and receipt of ultrasonic pulses 38, 40. For example, if the time period between emission and receipt is a certain value, the microprocessor 36 is programmed to correlate this value to a certain coin stack height. At step 104, the microprocessor 36 determines the number of coins 16 in the stack of coins 14 by dividing the determined height 42 by the known coin height 17 for the particular type of coin 16 held by the coin tube 32. At step 106, the microprocessor 36 calculates the total monetary value of the stack of coins 14 by multiplying the determined number of coins 16 in the stack of coins 14 by the known value for each individual coin 16.

Thereafter, as shown at step 108, the microprocessor 36 is arranged to sum the total value of the coins held by the coin dispenser 70 by summing the monetary values calculated for each stack of coins. This overall monetary value represents the total value for the coins 16 held by the automatic coin dispenser 70.

The overall monetary value may then be displayed on the display 22, at step 110, or printed on a printout, at step 112.

It should thus be recognized that according to the system and method of the present invention, a more efficient system and method for determining the number and value of coins in an automatic coin dispensing machine is provided. The present invention thus solves many problems associated with known evaluation systems and methods and eliminates inaccurate evaluations and waste of valuable labor time. The present invention also limits the number of individuals handling the coin inventory, thus deterring theft.

While this invention is susceptible to embodiments in many different forms, the drawings and specification describe in detail the preferred embodiments of the invention. They are not intended to limit the broad aspects of the invention to the embodiments illustrated.

What is claimed is:

1. A valuation system for determining the monetary value of coins included in a plurality of stacks of coins arranged for dispensing from an automatic coin dispensing machine, the valuation system comprising:

a single stationary sensor arranged to determine the height of the stack of coins in each of the plurality of stacks of coins as the plurality of stacks of coins rotate past the single sensor;

a microprocessor in communication with the sensor, the microprocessor adapted to determine the monetary value of coins in each of the plurality of stacks of coins by (A) determining the type of coin in each of the plurality of stacks of coins;

(B) determining the number of coins in each of the plurality of stacks of coins by dividing the determined height by a known coin height for the determined type of coin in each of the stacks of coins;

(C) determining a monetary value of the coins in each of the plurality of stacks of coins by multiplying the determined number of coins by a known coin value for the determined type of coin in each of the plurality of stacks of coins; and (D) determining an overall monetary value for the coins in the plurality of stacks of coins by summing the determined monetary value for each of the plurality of stacks of coins; and a display in communication with the microprocessor for visually displaying the overall monetary value of the plurality of stacks of coin.

2. The valuation system of claim 1, wherein the display is attached to the automatic coin dispensing machine.

3. The valuation system of claim 1, further comprising an activation button disposed on the automatic coin dispensing machine for manually activating the sensor and the microprocessor to determine the overall monetary value of the plurality of stacks of coins.

4. The valuation system of claim 1 wherein the sensor is an ultrasonic sensor.

5. The valuation system of claim 4 wherein the display visually displays the determined monetary value of the stack of coins only after manual activation of the activation button.

6. A method of determining the monetary value of coins in a plurality of stacks of coins arranged for dispensing from an automatic coin dispensing machine, the method comprising the steps of:

positioning a single, stationary sensor to determine the height of the stack of coins in each of the plurality of stacks of coins;

moving the plurality of stacks of coins past the single, stationary sensor;

determining the height of the stacks of coins in each of the plurality of stacks of coins;

determining the type of coins in each of the plurality of stacks of coins;

determining the number of coins in each of the plurality of stacks of coins by dividing the determined height for each of the stacks of coins by a known coin height for the determined type of coin in each of the plurality of stacks;

determining the monetary value of the coins in each of the plurality of stacks of coins by multiplying the determined number of coins by a known coin value for the determined type of coin in each of the plurality of stacks of coins;

determining an overall monetary value for the coins in the plurality of stacks of coins by summing the determined monetary value of the coins in each of the plurality of stacks of coins; and displaying the overall monetary value for the coins in the plurality of stacks of coins.

7. The method of claim 6 wherein the sensor determines the height of the stack of coins in each of the plurality of stacks of coins upon manual depression of an activation button.

8. A valuation system for determining the number and monetary value of a stack of coins arranged for dispensing from an automatic coin dispensing machine having a revolving carousel for holding a plurality of stacks of coins, the valuation system comprising:

an ultrasonic sensor arranged to emit an ultrasonic pulse onto a top coin in the stack of coins as the revolving carousel rotates each of the plurality of stacks of coins beneath the sensor and to receive the pulse after it reflects from the top coin;

a microprocessor in communication with the ultrasonic sensor, the microprocessor adapted to determine the number and value of coins in the stack of coins by (A) determining the height of the stack of coins;

(B) determining the type of coin in the stack of coins;

(C) determining the number of coins in the stack of coins by dividing the determined height of the stack of coins by a known coin height; and (D) determining the value of the stack of coins by multiplying the number of coins in the stack of coins by a known coin value.

9. The valuation system of claim 8, further comprising:

a display in communication with the microprocessor, the display for displaying the determined value for the stack of coins.

10. The valuation system of claim 9, wherein the display is attached to the automatic coin dispensing machine.

11. The value system of claim 8, further comprising:

a printing device in communication with the microprocessor, the printing device for printing the value of the stack of coins.

12. The valuation system of claim 8, wherein the ultrasonic sensor is mounted to an interior portion of a cover on the automatic coin dispensing machine.

13. The valuation system of claim 8, further comprising a button disposed on the automatic coin dispensing machine for manually-activating the ultrasonic sensor and microprocessor.

14. The valuation system of claim 8, wherein the microprocessor determines the number and value of coins in the stack of coins upon initiation by a user.

15. The valuation system of claim 8, wherein the microprocessor is adapted to determine the total value of coins in the plurality of stacks of coins in the revolving carousel by determining values for each of the plurality of stacks of coins and summing the determined values for each of the plurality of stacks of coins.

16. The valuation system of claim 8, wherein the microprocessor receives logic provided from automatic coin dispensing machine, wherein the logic is the known coin value of each stack of coins in the plurality of stacks of coins.

* * * * *